US006485017B1

(12) United States Patent
Ng

(10) Patent No.: US 6,485,017 B1
(45) Date of Patent: Nov. 26, 2002

(54) TOY TOP MAZE GAME

(76) Inventor: Ricky Ng, Hody Commercial Building, 3rd Floor, 6-6A Hart Ave, Tsim Sha Tsui (HK)

( * ) Notice: Subject to any disclaimer, the term of this patent is extended or adjusted under 35 U.S.C. 154(b) by 0 days.

(21) Appl. No.: 09/550,065

(22) Filed: Apr. 14, 2000

(51) Int. Cl.[7] ..... A63F 9/16

(52) U.S. Cl. ..... 273/108; 273/109; 273/110; 273/153 R

(58) Field of Search ..... 273/108, 109, 273/110, 287, 153 R, 113

(56) References Cited

U.S. PATENT DOCUMENTS 928,833 A * 7/1909 Zschokke ..... 273/153 R
3,540,731 A * 11/1970 Muncey ..... 273/109
3,674,271 A 7/1972 DeGelder et al.
3,706,455 A * 12/1972 Meyer ..... 273/110
3,820,793 A * 6/1974 Palmer ..... 273/153 R
3,844,562 A * 10/1974 Foley et al. ..... 273/110
4,055,341 A 10/1977 Martinez
4,258,918 A * 3/1981 Nishimiya ..... 273/110
4,408,413 A * 10/1983 Hyland et al. ..... 446/259 X
4,681,320 A * 7/1987 Hildebrandt ..... 273/109
4,964,637 A * 10/1990 Gebert ..... 273/113
5,129,655 A 7/1992 Gillespie et al.
5,971,830 A 10/1999 Tobin

* cited by examiner

*Primary Examiner*—Raleigh W. Chiu
(74) *Attorney, Agent, or Firm*—LaMorte & Associates, P.C.

(57) ABSTRACT

A toy top maze game. The maze game includes a maze board upon which at least one spinning top is placed. The maze board has a top surface. A grove is disposed in the top surface of the maze board. The groove defines a maze pathway capable of guiding the spinning top placed on the maze board. The maze pathway on the maze board follows a pattern that is capable of being selectively altered between a plurality of possible patterns. By changing the pattern of the maze pathway, different patterns can be created that vary in both length and complexity. Accordingly, the maze board can be reconfigured to match the skills of the person playing the game.

8 Claims, 3 Drawing Sheets

TOY TOP MAZE GAME

BACKGROUND OF THE INVENTION

1. Field of the Invention

In general, the present invention relates to the maze games where a player uses his/her dexterity to guide a game piece through the complex pathway of a maze. More particularly, the present invention relates to maze games where a spinning top is the object guided through the maze.

2. Description of the Prior Art

The prior art is replete with various different types of games where the objective of the game is to manipulate a game piece through a maze. The most common of such prior art games use a metal ball or marble as a game piece. The metal ball is placed on a maze that can be tilted in at least two different planes. By tilting the maze in different directions, the metal ball can be made to follow the path of the maze. Such prior art games are exemplified by U.S. Pat. No. 4,055,341 to Martinez, entitled Tilting Maze Race Game.

In order to make maze games a little more challenging, maze games have been developed where a spinning top is used as the game piece rather than a metal ball. By using a spinning top as the game piece, a player now only has a limited amount of time to complete the maze. If a player takes too long, the top will lose energy and stop spinning before it completes the maze. Maze games that use spinning tops are exemplified by U.S. Pat. No. 5,971,830 to Tobin, entitled Constructable Spinning Top Maze.

Maze games require that the players develop certain skills to successfully complete the game. With many prior art maze games, the maze is fixed. Accordingly, once a player successfully completes the maze, the game no longer is challenging and the player quickly loses interest in the game. Certain manufacturers address this problem by making mazes that are extremely difficult to complete. As such, a player may have to attempt the maze for many hours before the player has the experience and skills needed to complete the maze. However, such complex maze games are of no interest to smaller children who do not yet have the motor skills needed to play such a complex maze game.

A need therefore exists for a maze game that can be selectively varied both in its physical layout and in the level of skill needed to play the game. Such a maze game can then be played by a wider demographic of players and players will not quickly lose interest in the game. Such a need is met by the present invention as described and claimed below.

SUMMARY OF THE INVENTION

The present invention is a toy top maze game. The maze game includes a maze board upon which at least one spinning top is placed. The maze board has a top surface. A grove is disposed in the top surface of the maze board. The groove defines a maze pathway capable of guiding the spinning top placed on the maze board. The maze pathway on the maze board follows a pattern that is capable of being selectively altered between a plurality of possible patterns. By changing the pattern of the maze pathway, different patterns can be created that vary in both length and complexity. Accordingly, the maze board can be reconfigured to match the skills of the person playing the game.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
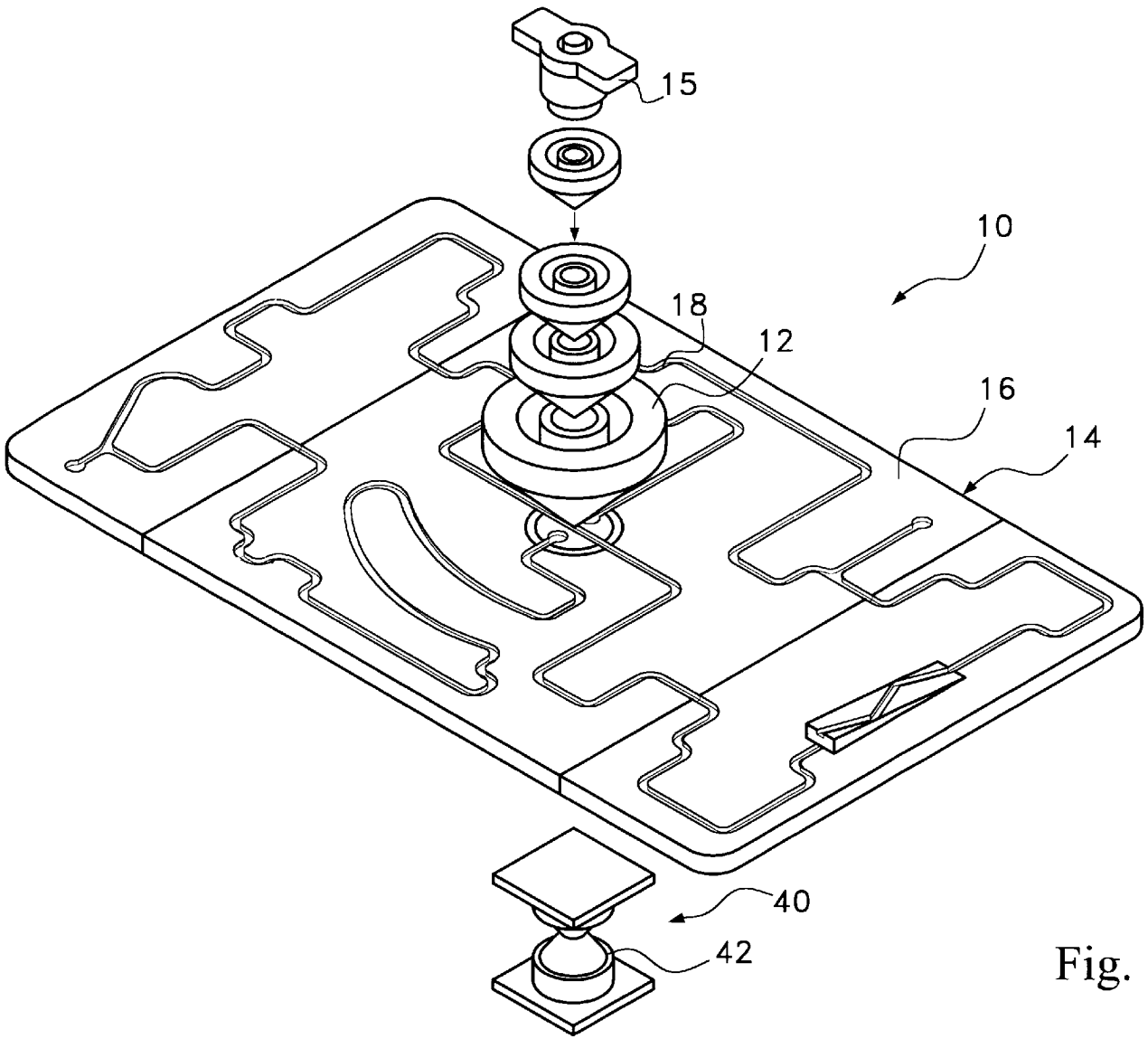
FIG. 1 is a perspective view of an exemplary embodiment of a maze game system in accordance with the present invention.

Referring to FIG. 1, a first embodiment of the present invention maze game system 10 is shown. The present invention maze game system 10 is a game where at least one spinning top 12 is placed on a maze board 14. The maze board 14 has a top surface 16 on which is formed a maze pathway 18. The maze pathway 18 is formed as a groove in the top surface 16 of the maze board 14. The maze pathway 18 follows a highly convoluted pattern around the maze board 14. At various points along the maze pathway 18 are positioned different mechanical obstacles, which will be later described.

A set of tops 12 is provided. The tops 12 are the game pieces of the game system 10. The objective of the game system 10 is to manipulate at least one of the tops 12 through the maze pathway 18 on the maze board 14 before the top 12 stops spinning. In the embodiment of FIG. 1, multiple tops 12 are shown. The present invention game system 10 can be played with either one top or any plurality of tops. When playing the game system 10, a top 12 is spun using a spring loaded launcher 15. The top 12 is then manipulated along the pathway 18 on the maze board 14 until the pathway 18 is complete. The way the top 12 is manipulated is by physically tilting the maze board 14 in different directions, thereby using gravity to influence the direction of the spinning top 12.

The level of difficulty associated with the amusement device 10 can be altered by using multiple tops. If a player has mastered the ability to complete the maze pathway 18 with a single top, the level of complexity can be increased by stacking multiple tops on top of one another. The stacked assembly of spinning tops must then be manipulated through the maze pathway 18. The level of complexity is increased because a player must first stack the spinning tops and then must move the stacked tops along the maze pathway 18 without any tops falling from the stack. Since time is consumed by the stacking of the tops, the time in which the stacked tops remain spinning is typically less than the time a single top will spin. Accordingly, a player can increase the difficulty of the game by adding tops to the stack. The more tops that are added, the more difficult the game will become and the less time will be available to complete the maze pathway 18.

In the shown embodiment of FIG. 1, there are four tops shown that are all graduated in size. It will be understood that any plurality of tops can be used and the tops can be of any sizes. A system of graduated tops is shown in co-pending patent application No. 09/???, ???, entitled, TOY TOP SYSTEM, which is assigned to Agglo Corporation Ltd., the assignee herein. The disclosure of this co-pending application is herein incorporated into this application by reference.

Figure 2:
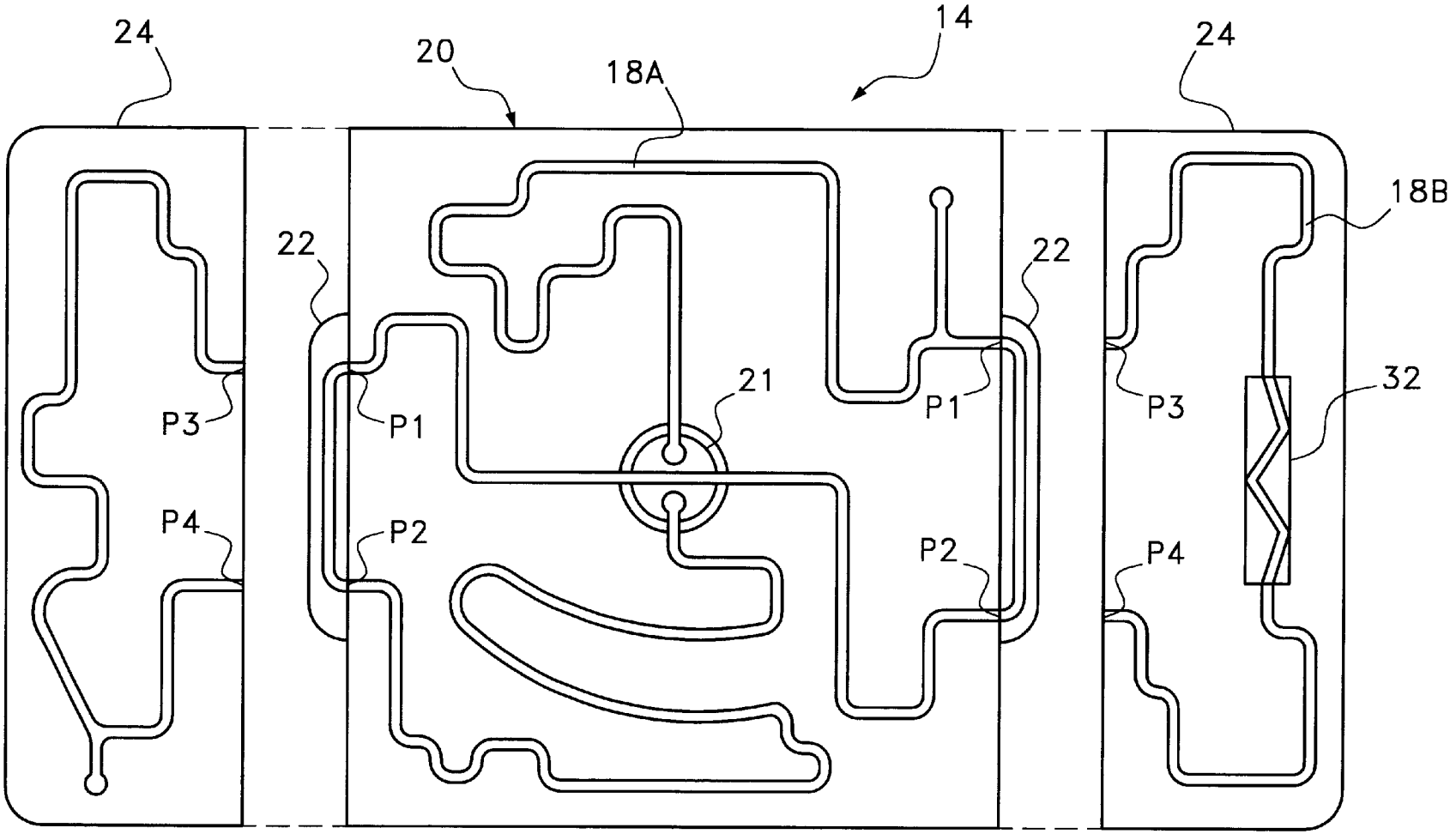
FIG. 2 is an exploded top view of the maze board used in the system of FIG. 1.

Referring to FIG. 2, a top view of the exemplary maze board 14 is shown. The maze board 14 can be a single piece with a fixed maze path. However, in the preferred embodiment, the maze board 14 has a multi-part modular construction that enables the overall maze pathway 18 (FIG. 1) to be selectively altered. The maze board 14, contains a central board element 20. The central board element 20 contains a complete maze pathway 18A. The maze pathway 18A may contain certain mechanical obstacles, such as the turn table 21 shown in the middle of the central board element 20, in order to make the maze pathway 18 more challenging.

At two opposite sides of the central board element 20 are extensions 22. The extensions 22 are directly opposed to one another and are centered on the sides of the central board element 20. The maze pathway 18A enters and exits each of the extensions at identically positioned points P1, P2. Furthermore, as the maze pathway 18 enters the extensions 22, the maze pathway 18A at both points P1, P2 are parallel.

The maze board 14 also includes two side board A elements 24. Each of the side board elements 24 contains a segment of the maze pathway 18B, that begins at a first point P3 and ends at a second point P4. The side board elements 24 are selectively attachable to the sides of the central board element 20. The extensions 22 that extend from the sides of the central board element 20 pass into the side board elements 24 and lock the side board elements 24 into place. Once locked into place, the maze pathway 18B present on the side board elements 24 align with the maze pathway 18A embodied on the central board element 20, thereby producing a complete maze pathway 18 such as that shown in FIG. 1.

Obviously, the maze pathway 18A on the central board element 20 is extended when one or both of the side board elements 24 are added to the central board element 20. Consequently, by selectively adding one or both of the side board elements 24 to the central board element 20, the level of difficultly associated with the game system can be selectively altered.

The side board elements 24 contain a top surface and a bottom surface. A segment of maze pathway 18B can be manufactured onto both of these surfaces. Accordingly, each of the side board elements 24 can be attached to the central board element 20 in one of two possible orientations. When in a first orientation, each side board element 24 will provide a new section of the maze pathway to the game system. When turned upside down, each side board element 24 provides a different section of the maze pathway to the game system. The different sides of the side game elements 24 can have difficulty ratings associated with them. One side of a side board element 24 can have an easily traversed section of maze pathway, while the opposite of that same side board element 24 can have a difficult section of maze pathway. Accordingly, a player can select the difficultly level of the game system by adding the side board elements 24 to the central board element 20 in different orientations.

Figure 3:
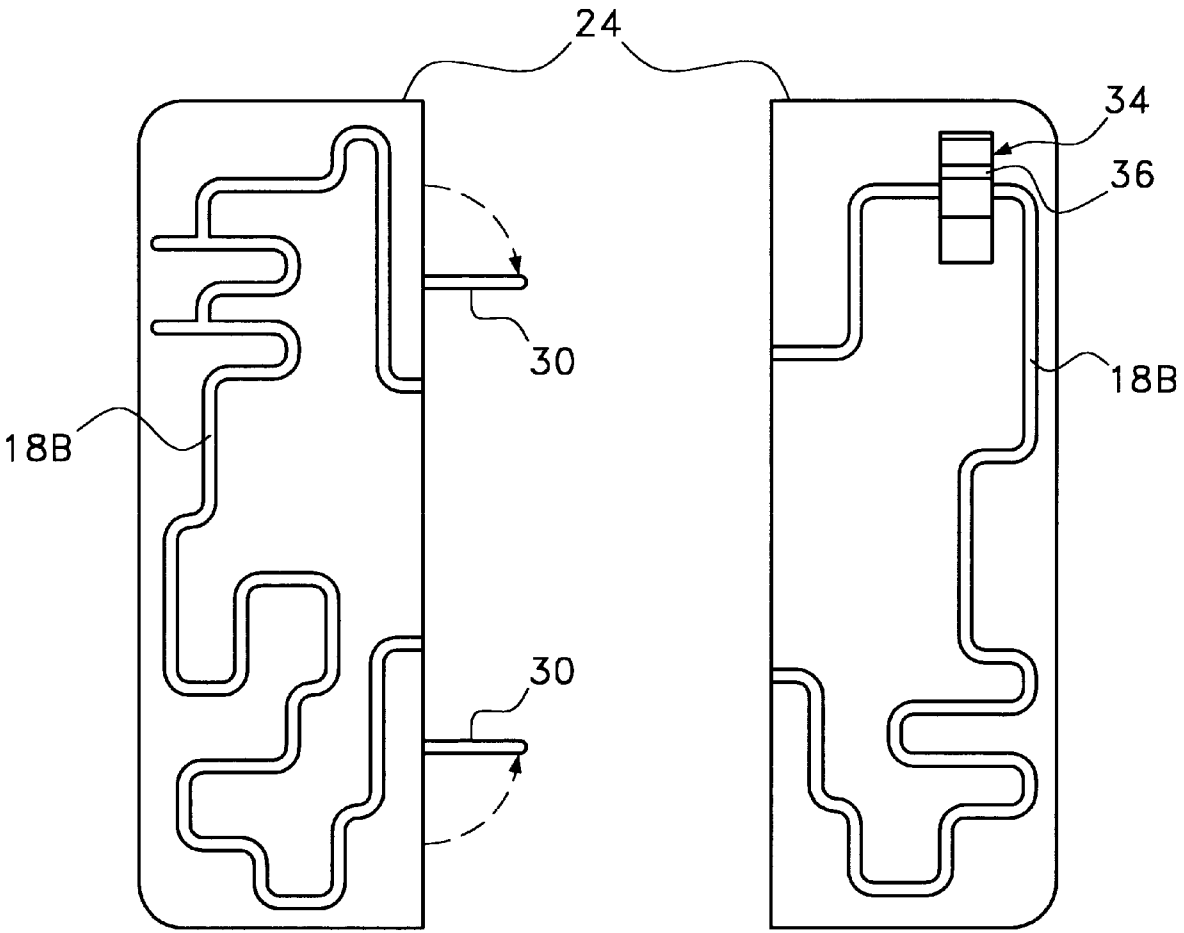
FIG. 3 is a top view of a secondary maze board made from the side board elements shown in FIG. 2.

For some players, the central board element 20 of the game system by itself may be too difficult for their level of skill. For this reason the two side board elements 24 can be directly joined together. Referring to FIG. 3, it can be seen that the two side board elements 24 can be directly joined together. When the two side board elements 24 are joined together, the maze pathway 18B on each of the side board elements 24 align, thereby creating a continuous maze pathway. The resulting maze pathway is shorter than the maze pathway 18A (FIG. 2) on the central board element 20 (FIG. 2). Accordingly, the maze pathway will take less time to complete, and thus requires less skill to complete.

The pattern of the maze pathway 18B shown on the side board elements 24 in FIG. 3 is different from the pattern of the maze pathway shown in FIG. 1 and FIG. 2. This is because in FIG. 3, the opposite sides of the side board elements 24 are shown. As has been previously stated, the side board elements 24 have different maze pathway patterns on opposing sides. The illustration of FIG. 3 is used to demonstrate this point.

There are many different mechanical means that can be used to physically interconnect the two side board elements 24 together. In the shown embodiment, one of the side elements contains folding connector arms 30 that can be extended toward the opposite side board element. These connector arms 30 pass into slots on the opposite side board element, thus joining the two side board elements 24 into a single playing board.

The difficulty associated with the maze pathway in the game system is determined by three variables. Those variables are the length of the pathway, the complexity of the pathway and the presence of mechanical obstacles in the pathway. Referring back to FIG. 2, it can be seen that in the middle of the central board element is a turn table 21. The turn table has points where the maze pathway 18A connects to it. However, the turn table 21 only connects two of those points at a time. The turn table 21 is free to turn. To turn the turn table 21, a player must manipulate a spinning top onto the turn table 21 and then use the weight of the spinning top to rotate the turn table 21 in different directions. Also in FIG. 2, the use of a seesaw obstacle 32 is shown. The seesaw obstacle 32 has a fulcrum under its center. As such, only one end of the seesaw obstacle 32 is in the same plane as the remainder of the maze pathway. The opposite end of the seesaw obstacle 32 is elevated. As such, in order for a top to pass over the seesaw obstacle 32, the top must approach the seesaw obstacle 32 from the side of the obstacle that is not elevated. In FIG. 3, a slide obstacle 34 is shown along the pathway 18B in one of the side board elements 24 of the game. The slide obstacle 34 contains a segment of pathway 36 that moves back and forth along a slot. In order for a spinning top to pass over the slide obstacle 34, the slide obstacle 34 must be manipulated so that the segment of pathway 36 on the slide obstacle 34 aligns with the adjoining sections of maze pathway 18B.

The described mechanical obstacles are merely exemplary and there are many other forms of mechanical obstacles that can be added to the present invention game system. Such obstacles can include, but are not limited to, depressions in the maze pathway, bumps in the maze pathway and restrictions in the maze pathway.

Returning to FIG. 1, it will be understood that the maze board 14 can be manipulated by holding the maze board 14 in a player's hands. However, the maze board 14 may also come with a stand 40. The stand 40 has a flat base that supports the maze board 14 above a table. The stand 40 also includes a ball joint 42 that enables the maze board 14 to be tilted in any direction while supported on the stand 40.

It will be understood that the embodiment of the present invention game device that is described and illustrated herein is merely exemplary and a person skilled in the art can make many variations to the embodiment shown without departing from the scope of the present invention. All such variations, modifications and alternate embodiments are intended to be included within the scope of the present invention as defined by the appended claims.

What is claimed is:

1. A maze device, comprising:

a planar structure having a top surface of a first area with a groove disposed thereon, wherein said groove defines at least one continuous pathway that extends a predetermined distance from a common point on said top surface, whereby said common point serves as both a starting point and a finishing point;

at least one subsequent planar element that is selectively attachable to said planar structure, therein increasing said area of said top surface, wherein each said at least one subsequent planar element has a groove disposed thereon that becomes part of said at least one pathway an increases said predetermined distance.

2. The device according to claim 1, wherein each said at least one subsequent planar element has a first surface and an opposite second surface and a groove is formed on both said first surface and said second surface, wherein said at least one subsequent board element can be selectively attached to said planar structure in two orientations so that either said first surface or said second surface becomes part of said top surface of said planar structure.

3. The device according to claim 1, further including a stand for supporting said planar structure.

4. The device according to claim 3, wherein said stand contains a ball joint, thereby enabling said planar structure to be tilted in a variety of directions while still being supported by said stand.

5. The device according to claim 1, wherein said planar structure includes at least one obstruction mechanism that intersects said pathway, each said obstruction mechanism selectively positionable between a first condition that obstructs said pathway and a second condition that does not obstruct said pathway.

6. A maze device, comprising:

a planar structure having a top surface of a first area with a primary groove disposed thereon, wherein said primary groove defines at least one pathway that extends a predetermined distance from a starting point to a finishing point on said top surface;

at least one subsequent planar element having a first surface, an opposite second surface and a secondary groove formed on both said first surface and said second surface, wherein said at least one subsequent planar element can be selectively attached to said planar structure in two orientations so that either said first surface or said second surface becomes part of said top surface of said planar structure, therein increasing said area of said top surface, wherein said secondary groove becomes part of said at least one pathway an increases said predetermined distance between said starting point and said finishing point.

7. The device according to claim 6, wherein said starting point and said finishing point are located at a common point on said at least one pathway and said at least one pathway is a continuous loop.

8. A method of altering the complexity of a maze through which a spinning top is passed, comprising the steps of:

providing a planar structure on which is disposed a continuous pathway that extends from a common point that serves as both a starting point and a finishing point, said pathway having a known length and degree of complexity;

providing at least one subsequent planar element, wherein each said planar element has a groove disposed thereon;

selectively interconnecting said at least one subsequent planar element to said planar structure, wherein said groove on said at least one subsequent planar element becomes part of said pathway, thereby selectively altering said length and said degree of complexity of said pathway.

* * * * *